US011043775B2

(12) United States Patent
Brode et al.

(10) Patent No.: US 11,043,775 B2
(45) Date of Patent: Jun. 22, 2021

(54) CABLE SHIELD CONTACTING DEVICE AND ELECTRIC PLUG CONNECTOR

(71) Applicant: PHOENIX CONTACT GmbH & Co. KG, Blomberg (DE)

(72) Inventors: Manfred Brode, Öschelbronn (DE); Michael Delker, Herrenberg (DE); Jörg Zenkner, Forchtenberg (DE); Morten Harren, Herrenberg (DE)

(73) Assignee: PHOENIX CONTACT GmbH & Co. KG, Blomberg (DE)

( * ) Notice: Subject to any disclaimer, the term of this patent is extended or adjusted under 35 U.S.C. 154(b) by 0 days.

(21) Appl. No.: 16/767,255

(22) PCT Filed: Dec. 19, 2018

(86) PCT No.: PCT/EP2018/085795
§ 371 (c)(1),
(2) Date: May 27, 2020

(87) PCT Pub. No.: WO2019/134828
PCT Pub. Date: Jul. 11, 2019

(65) Prior Publication Data

US 2020/0358209 A1 Nov. 12, 2020

(30) Foreign Application Priority Data

Jan. 8, 2018 (BE) ..... 2018/5006

(51) Int. Cl.
*H01R 13/6592* (2011.01)
*H01R 9/03* (2006.01)
(Continued)

(52) U.S. Cl.
CPC ..... *H01R 13/6592* (2013.01); *H01R 9/03* (2013.01); *H01R 9/05* (2013.01); *H01R 9/0524* (2013.01);
(Continued)

(58) Field of Classification Search
CPC ..... H01R 2103/00; H01R 9/0524; H01R 13/6592; H01R 9/05; H01R 13/6583;
(Continued)

(56) References Cited

U.S. PATENT DOCUMENTS 5,730,623 A * 3/1998 Krantz ..... H01R 24/44 439/580
5,941,717 A * 8/1999 Schauer ..... H01R 9/0524 439/98
(Continued)

FOREIGN PATENT DOCUMENTS

DE 197 26 005 A1 2/1999
DE 201 19 898 U1 3/2002
(Continued)

OTHER PUBLICATIONS

International Search Report for corresponding Application No. PCT/EP2018/085795, dated Mar. 6, 2019.

*Primary Examiner* — Edwin A. Leon
*Assistant Examiner* — Matthew T Dzierzynski
(74) *Attorney, Agent, or Firm* — Renner, Otto, Boisselle & Sklar, LLP

(57) ABSTRACT

An electric cable shield contacting device for an electric plug connector, and to an electric plug connector having such a cable shield contacting device, wherein the plug connector has an at least partly hollow cylindrical housing having a contact carrier accommodated therein, and having an end cap that can be screwed onto the latter. The cable shield contacting device has a clamping sleeve and a clamping basket, which are correspondingly hollow-cylindrical and engage partly over each other in order to clamp the shield braid between themselves, having a circumferential stowage space for projecting shield braid in the overlap area. The inner circumferential surface of the clamping basket has multiple projecting shield braid driving elements arranged in
(Continued)

the form of a circular ring, which engage in a circumferential annular groove on the outer circumferential surface of the clamping sleeve and thus latch clamping basket and clamping sleeve rotatably in each other.

9 Claims, 2 Drawing Sheets

(51) Int. Cl.
*H01R 9/05* (2006.01)
*H01R 13/6583* (2011.01)
*H01R 13/6591* (2011.01)

(52) U.S. Cl.
CPC ... *H01R 13/6583* (2013.01); *H01R 13/65912* (2020.08)

(58) Field of Classification Search
CPC .. H01R 2105/00; H01R 24/58; H01R 13/187; H01R 13/5845; H01R 13/65912; H01R 13/65915; H01R 24/56; H01R 24/562; H02G 15/085; H02G 3/0666
See application file for complete search history.

(56) References Cited

U.S. PATENT DOCUMENTS 6,048,227 A 4/2000 Rupp
6,583,352 B2 * 6/2003 Fukushima ..... H02G 3/088 174/373
6,672,894 B2 * 1/2004 Sprunger ..... H01R 13/65912 439/449
6,805,588 B2 * 10/2004 Yamamoto ..... H01R 9/035 439/607.41
7,147,513 B2 * 12/2006 Wada ..... H01R 13/6585 439/607.43
7,189,117 B2 * 3/2007 Kawamura ..... H01R 13/6592 439/607.48
7,268,298 B2 * 9/2007 Asakura ..... H01R 9/0512 174/78
7,819,694 B2 * 10/2010 Miyashita ..... H01R 9/05 439/585
8,419,469 B2 * 4/2013 Montena ..... H01R 24/58 439/578
8,602,797 B2 * 12/2013 Omae ..... H01R 13/6592 439/99
10,211,547 B2 * 2/2019 Burris ..... H01R 43/16
2016/0056550 A1 2/2016 Justi
2019/0190181 A1 * 6/2019 Biller ..... H01R 9/0527
2020/0212620 A1 * 7/2020 Takahashi ..... H01R 13/748

FOREIGN PATENT DOCUMENTS

DE 199 44 167 B4 8/2008
DE 10 2013 009 184 A1 12/2014
EP 0822633 A1 2/1998
EP 1 667 284 A1 6/2006
EP 2 190 071 A1 5/2010
EP 3139446 A1 3/2017

* cited by examiner

CABLE SHIELD CONTACTING DEVICE AND ELECTRIC PLUG CONNECTOR

DESCRIPTION

Technical Field Of The Invention

The invention relates to an electrical cable shield contacting device for an electrical plug connector for contacting a shielding braid of an electrical shielded sheathed cable, wherein the plug connector comprises a housing that has an at least in part cylindrical inner and outer circumference, a contact carrier that is arranged in the housing and an end cap that may be screwed onto the housing, and wherein the cable shield contacting device is designed at least in two parts and may be inserted into the housing, a clamping sleeve and a clamping cage that are designed in a corresponding hollow cylindrical manner and are arranged at least in part one engaging over the other and that clamp the shielding braid between one another at a clamping site, wherein the clamping sleeve and the clamping cage comprise sheath surfaces that are spaced away from one another in their overlapping region, said sheath surfaces forming a circumferential annular duct-shaped stowage space for receiving a length region that is part of the shielding braid and that overlaps the clamping sleeve and the clamping cage in the axial direction, the clamping sleeve and the clamping cage may be rotated with respect to one another and form with one another a coiling device for the length region that is part of the shielding braid and overlaps the clamping sleeve and/or the clamping cage in the axial direction, and the sheath surface of the clamping cage comprises a plurality of radially protruding shielding braid entraining elements that are arranged on one or multiple circular rings and extend as far as the sheath surface of the clamping sleeve.

The invention relates in addition to an electrical plug connector having a housing that has an at least in part cylindrical inner and outer circumference, a contract carrier that is arranged in the housing and an end cap that may be screwed onto the housing, and having an electrical cable shield contacting device for contacting a shielding braid of an electrical shielded sheathed cable.

Discussion Of The Related Art

Generic-type electrical plug connectors having an electrical cable shield contacting device that is designed as described in the introduction or in a similar manner are known in numerous embodiments from the prior art. By way of example, reference is made to the publications DE 201 19 898 U1, DE 10 2013 009 184 A1, DE 199 44 167 B4, DE 97 26 005 A1, EP 2 190 071 A1 and EP 1 667 284 B9.

The document EP 1 667 284 B9 thus discloses for example an electrical plug connector having a contacting device for a cable shield of an electrical cable, having a housing that has an at least in part cylindrical inner and outer circumference, having a contact carrier that is arranged in the housing, having an end cap that may be screwed onto the housing, and having two corresponding annular elements that overlap one another at least in part for contacting the cable shield, which comprise sheath surfaces that are spaced away from one another in their overlapping region and may be rotated with respect to one another and which form with one another a coiling device for coiling a length region that is part of the cable shield in a stowage space that is defined by the sheath surfaces. In this case, the inner annular element and the outer annular element are arranged engaging over the cable shield, wherein the cable shield may be folded over by 180° about an end face that is part of the inner annular element and faces in the direction of the outer annular element in such a manner that a first length region of the cable shield extends between the cable and the inner annular element. It is possible by means of the coiling device for the length region that is part of the cable shield and overlaps the axial length of the inner annular element to be coiled in the form of a spiral in the stowage space by rotating the annular elements with respect to one another. For this purpose, the sheath surface of the outer annular element comprises on the face that is facing the inner annular element a plurality of radially-protruding, bend-rigid shielding braid entraining elements that are arranged on one or multiple imaginary circular rings and that extend as far as the sheath surface of the inner annular element. The two annular elements are locked with one another in such a manner as to be able to rotate in the axial direction, wherein the shielding braid entraining elements of the outer annular elements engage with a circumferential bead that is arranged on an outer sheath of the inner annular element.

In the case of this known electrical plug connector or rather the provided contacting device, it is regarded as disadvantageous that the length region that is part of the cable shield and overlaps the axial length of the inner annular element must be cut open or debraided at least once, ideally more than once, in the axial direction, in order to be able to coil the overlapping length region in the form of a spiral into the stowage space by rotating the two annular elements with respect to one another.

Summary Of The Invention

Based on the above described prior art, the object of the invention is to propose a possibility whereby the length region that is part of the cable shield and overlaps the axial length of the inner and/or outer annular element may be coiled up into the stowage space without having first to cut open or debraid the cable shield in the axial direction. In this case, the contacting device is to have a particular simple and cost-effective structure, and in particular be simple to assemble on a cable that comprises a cable shield and in addition be able to produce an electrically particularly reliable shield contacting arrangement.

This object is achieved in accordance with the invention by means of an electrical cable shield contacting device for an electrical plug connector for contacting a shielding braid of an electrical shielded sheathed cable in accordance with the independent claim 1 and by means of an electrical plug connector that comprises an electrical cable shield contacting device in accordance with the co-ordinated claim 7. Further advantageous embodiments are disclosed in the respective related claims.

Accordingly, in the case of the electrical cable shield contacting device in accordance with the invention for an electrical plug connector for contacting a shielding braid of an electrical shielded sheathed cable, the outer sheath surface of the clamping sleeve comprises on a front sleeve end that is engaged by the clamping cage one or multiple circumferential annular grooves, annular collars and/or annular steps into which and/or behind which the shielding braid entraining elements of the clamping cage engage and latch the clamping cage with the clamping sleeve. Consequently, the shielding braid entraining elements extend beyond the clamping cage not only as far as the outer sheath surface of the clamping sleeve but rather further beyond. It is preferred that the clamping cage comprises a number of shielding braid entraining elements that are arranged on one or multiple circumferential circular tracks, wherein in the case of multiple circular tracks and the annular grooves, annular collars and/or annular steps that are provided, these are formed in a corresponding manner on the clamping sleeve and the clamping cage and comprise preferably in each case an equivalent spacing between one another.

This cable shield contacting device comprises multiple parts, preferably two parts, and is formed by a clamping sleeve and a clamping cage that are configured in a correspondingly hollow cylindrical manner and are arranged at least in part one engaging over the other. In addition, it is also possible to provide as an alternative a further part for the shielding arrangement. The clamping sleeve and the clamping cage comprise sheath surfaces that are spaced away from one another in their overlapping region and define a circumferential annular duct-shaped stowage space for receiving a length region that is part of the shielding braid and overlaps the clamping sleeve in the axial direction. The clamping sleeve and the clamping cage may be continuously rotated with respect to one another in both the clockwise and anti-clockwise direction and together form a coiling device for the length region that is part of the shielding braid and overlaps the clamping sleeve and/or the clamping cage in the axial direction. A number of radially-protruding, preferably bend-rigid shielding braid entraining elements that are arranged on one or multiple circular rings are formed on the inner sheath surface of the clamping cage that engages the clamping sleeve outside at least in part and, as the clamping sleeve is rotated with respect to the clamping cage or the clamping cage is rotated with respect to the clamping sleeve, said shielding braid entraining elements act on the shielding braid via the clamping sleeve and/or via the clamping cage and coil the axially overlapping length region of the shielding braid into the stowage space. In this case, the shielding braid entraining elements that protrude inward from the clamping cage may be arranged either on an in itself closed, dimensionally-stable sheath surface of the clamping cage or on sheath surface segments that are part of the clamping cage and may be deflected in the radial direction. Such shielding braid entraining elements that are configured flexible and able to deflect in the radial direction may compensate larger cable diameters that are larger or equal to the inner diameter of the clamping cage.

The electrical cable shield contacting device in accordance with the invention may be inserted into a housing of an electrical plug connector for contacting the shielding braid of the electrical shielded sheathed cable, wherein the plug connector comprises a housing that has an at least in part cylindrical inner and outer circumference, a contact carrier that is arranged in the housing and an end cap that may be screwed onto the housing and fixes the cable shield contacting device in the housing in a positionally-stable manner in the axial and circumferential direction. In the state inserted into the housing, the end cap that may be screwed to the housing applies force to the clamping cage in the axial direction and holds said clamping cage against the clamping sleeve in the axial direction, said clamping sleeve supporting itself inside against the housing. This reinforces the clamping arrangement of the shielding braid at the clamping site between the clamping sleeve and the clamping cage.

In a favorable manner, the at least one annular groove of the clamping sleeve and the shielding cable carriers of the clamping cage have a shape that matches one another in particular in their cross-section, in such a manner that the shielding braid entraining elements extend with a slight air gap to the base of the annular groove in the associated annular groove. Consequently, the individual wires of the shielding braid rotate safely with respect to one another at the same time as the clamping sleeve and the clamping cage rotate with the result that said individual wires may be reliably coiled in the form of a spiral into the stowage space.

In principle, the shielding braid entraining elements may have any geometric shape. It has proven to be particularly favorable for the shielding braid entraining elements to be symmetrical, i.e., mirror-inverted, in the circumferential direction and with a tip at the free end, by way of example to be conical- or pyramid-shaped. Consequently, the length region of the shielding braid that is to be coiled may be coiled into the stowage space either in a clockwise direction or in an anti-clockwise direction. It is preferred that the shielding braid entraining elements, which are part of the clamping cage and protruding radially in the direction of the clamping sleeve are formed on the clamping cage, are designed in the shape of a pyramid. Consequently, said shielding braid entraining elements are not only symmetrical in the circumferential direction of the clamping cage but rather they comprise in addition an entraining tip that as the cable shield contacting device connects with the electrical shielded sheathed cable penetrates into the shielding braid, which it punctures and thus ensures that the shield wires of the cable shield are drawn into the stowage space and coiled without any problem, wherein it is possible to debraid part of the shielding braid.

In the case of a preferred embodiment of the invention, the clamping sleeve comprises two shell-shaped, in particular semi-shell-shaped, sleeve parts. Consequently, these are particularly simple and cost-effective to manufacture. In the case of favorable variants, said sleeve parts are connected to one another in an articulated manner, by way of example by means of a hinge, and are designed so as to be able to latch with one another. Consequently, the assembly procedure is also facilitated.

In the case of an embodiment of the cable shield contacting device in accordance with the invention, the clamping cage comprises on its end face facing the clamping sleeve a circumferential end profiling for fixing in a rotation-resistant manner in the housing, said profiling comprising a plurality of mutually adjacent depressions and elevations that form a closed profiled annular ring. In the case of a further preferred embodiment of the cable shield contacting device in accordance with the invention, the clamping sleeve comprises in a middle region a circumferential annular step and/or a circumferential annular collar against which the end profiling of the clamping cage is in contact and can support itself there. The combination of the two above described special embodiments have proven to be particularly favorable. The depressions of the profiled annular ring that is arranged on the end face are designed in the circumferential direction preferably with a tooth-shaped cross-section. Thus, as the electrical cable shield contacting device is assembled, i.e. as it is attached to and connected to the electrical shielded sheathed cable, the wires of the shielding braid of the cable shield that overlap the clamping sleeve and/or the clamping cage in the axial direction may be fed through the depressions of the profiled annular ring in a simple manner and subsequently are introduced into the circumferential annular duct-shaped stowage space by means of the coiling device.

In the case of an advantageous embodiment, the end profiling protrudes in the radial direction beyond the annular step or the annular collar. The radial overlap renders it possible to provide support in a particularly simple and effective manner and in conjunction with the provided means of protection against rotation also renders it possible to connect in a rotation-resistant manner the electrical cable shield contacting device that is arranged in the housing.

In the case of a favored embodiment of the electrical cable shield contacting device in accordance with the invention, apart from the depressed annular grooves and the protruding shielding braid entraining elements, the sheath surfaces of the clamping sleeve and of the clamping cage are designed in their overlapping region with smooth walls. Consequently, the length region that is part of the shielding braid and overlaps the clamping sleeve and/or the clamping cage is prevented from becoming hooked in as it is coiled in the stowage space and in addition the procedure of feeding in said length region is facilitated.

In the case of the proposed cable shield contacting device, the clamping sleeve and/or the clamping cage are designed as metal molded parts or from synthetic material. In the case of a preferred embodiment of the invention, the clamping sleeve and the clamping cage of the cable shield contacting device are designed as a synthetic material molded body. The shielding arrangement is contacted in this case via the metal housing. On the one hand, the insulating clamping sleeve prevents an undesired electrical contact with the electrical contacts of the contact carrier or with the non-insulated connection sites of the cables of the sheathed cable and on the other hand renders it possible to manufacture the synthetic material molded part in a cost-effective manner.

The electrical plug connector in accordance with the invention comprises an electrical cable shield contacting device in accordance with the invention as described above. This cable shield contacting device is arranged in a housing that has an at least in part cylindrical inner and outer circumference and in which at least one single-pin contact carrier is arranged. The housing comprises an end cap that may be screwed on and traps and holds the cable shield contacting device in a positionally-secure manner in the housing for contacting a shielding braid of an electrical shielded sheathed cable and the contact carrier, to which the at least one inner cable that is shielded from the shielding braid may be connected. Furthermore, the housing of the electrical plug connector may comprise a rotating locking sleeve for fixing in a vibration-resistant and sealed manner on a counter plug part. It is preferred in this case that, when the cable shield contacting device is inserted into the housing, the clamping sleeve having the annular collar is supported on a counter bearing of the housing in an unshiftable manner in the axial direction, wherein the clamping cage having the end profiling lies against a counter profiling of the housing in a non-rotatable manner in the circumferential direction. As a consequence, the cable shield contacting device that is inserted into the housing is fixed in the housing in a non-movable manner in the axial direction and in the circumferential direction by means of the end cap that is screwed onto the housing.

The features mentioned above in the description and feature combinations and also the features that are mentioned below in the description of the figures and/or are illustrated alone in the figures and feature combinations are not only useable in their respective described combination but rather may also be used in other combinations or as standalone. It is not necessary to realize all the features of claim 1 in order to implement the invention. Individual features of the independent or coordinate claims may also be replaced by other disclosed features or feature combinations.

All the features that arise from the claims, the description or the drawing and/or advantages, including constructive details, spatial arrangement and method steps may be essential for the invention both as standalone and also in the most varied combinations. In the figures, like or similar components are provided with like or similar reference numerals.

BRIEF DESCRIPTION OF THE DRAWINGS

The invention is further explained below with reference to exemplary embodiment illustrated in the accompanying drawing. In a schematic view.

DETAILED DESCRIPTION OF THE INVENTION

Figure 1:
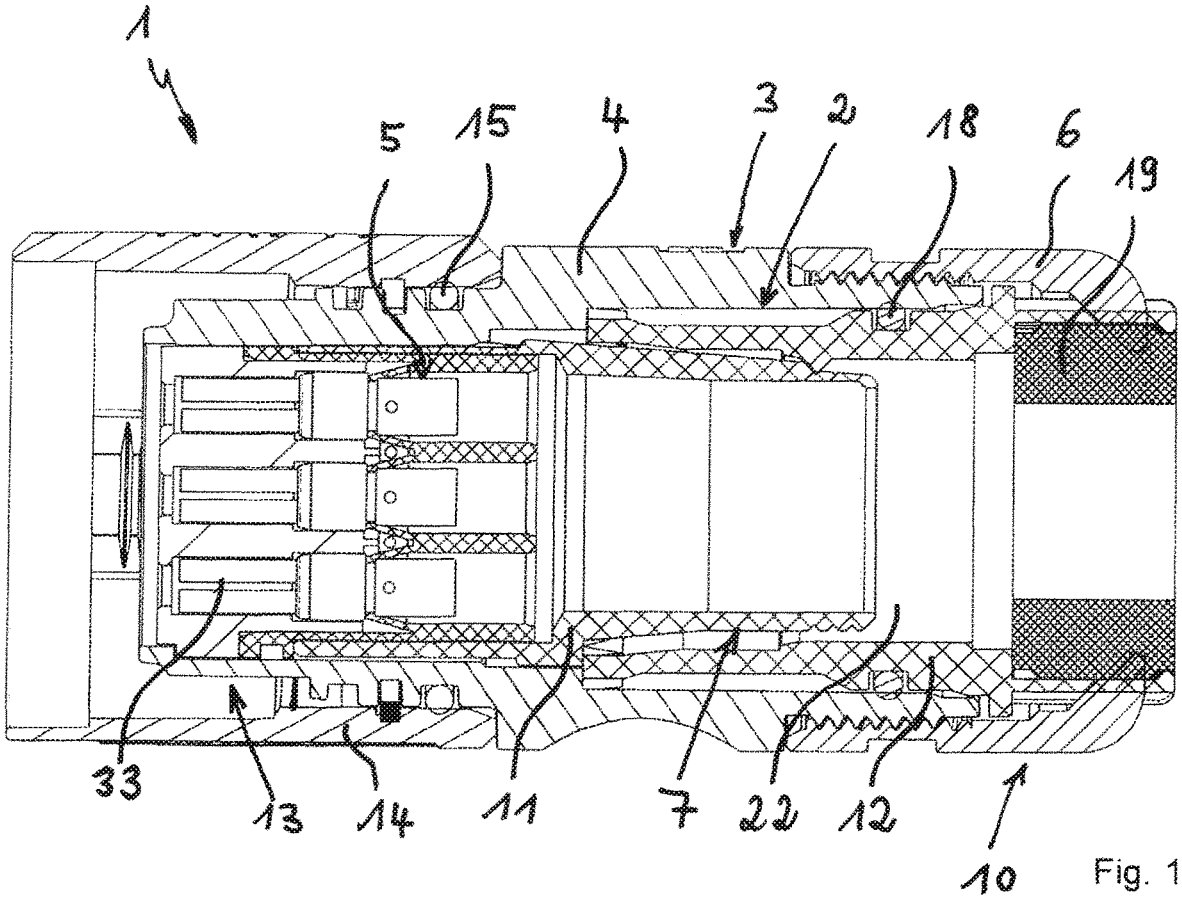
FIG. 1 illustrates in a longitudinal sectional view an electrical plug connector in accordance with the invention having an electrical cable shield contacting device in accordance with the invention for contacting a shielding braid of an electrical shielded sheathed cable that comprises a clamping sleeve and a clamping cage.

FIG. 1 illustrates an exemplary embodiment of the electrical plug connector 1 in accordance with the invention, having a housing 4 that has an at least in part cylindrical inner (2) and outer (3) circumference, a contact carrier 5 that is arranged in the housing 4, and an end cap 6 that may be screwed onto the housing 4 and having an electrical cable shield contacting device for contacting a shielding braid 8 of an electrical shielded sheathed cable 9. The sheathed cable 9 with its shielding braid is not illustrated in FIG. 1 for the sake of a better overview. Said sheathed cable is illustrated in the following FIGS. 3 and 4. The end cap 6 engages the housing 4 on a rear end 10 of the housing 4, said rear end being remote from the contact carrier 5 and the electrical cable shield contacting device 7 that comprises a clamping sleeve 11 and a clamping cage 12 being arranged in said housing. A rotating locking sleeve 14 is arranged on a front end 13 of the housing 4, said end extending with an axial spacing to the rear end 10 of the housing 4, said rotating locking sleeve being fixed in a rotatable manner on the front end 13 in which the contact carrier 5 is arranged in an unshiftable and non-rotatable manner. By means of the rotating locking sleeve 14, the electrical plug connector 1 may be fixed in a vibration-resistant manner on a counter plug that is not illustrated in the figure, the plug-in end of said counter plug being designed in a complementary manner to that of the plug connector 1. The rotating locking sleeve 14 is attached in a known manner to the front end 13 of the housing 4 and comprises a sealing ring 15 with respect to the housing 4 as a vibration brake. The contact carrier 5 comprises in this case a number of plug contacts 33.

Figure 4:
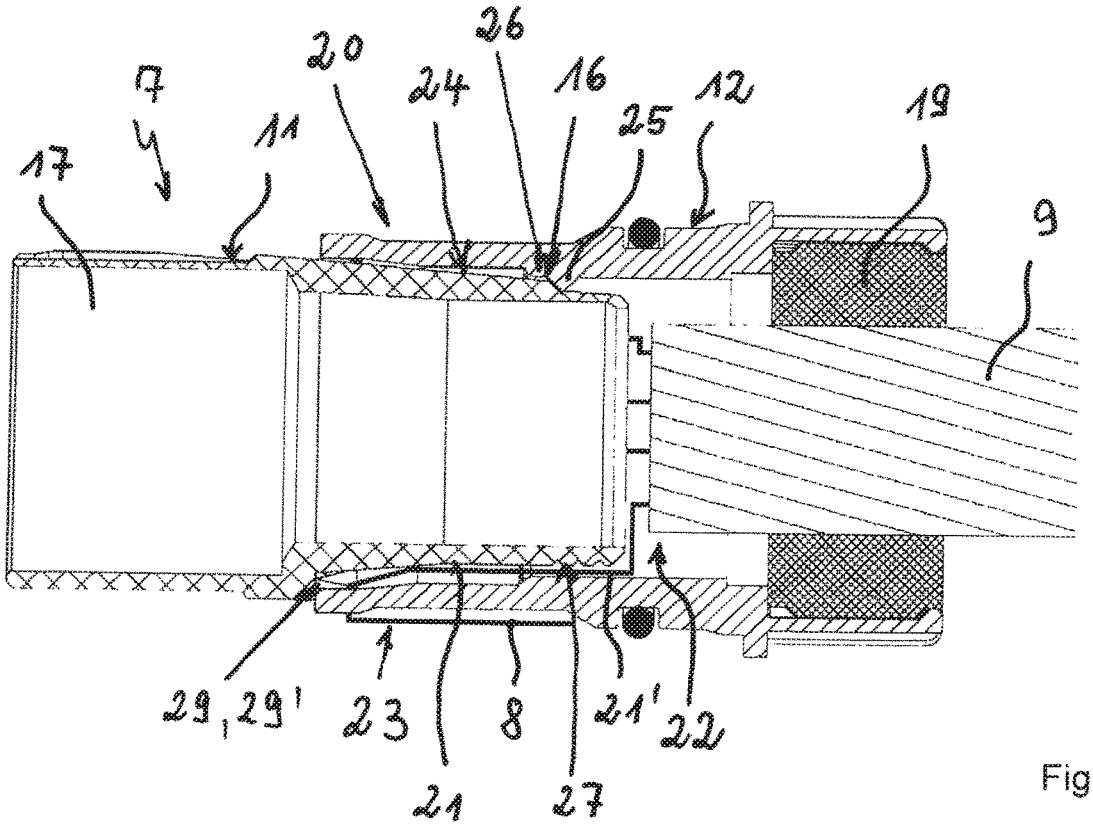
FIG. 4 illustrates in a longitudinal sectional view the cable shield contacting device in accordance with the invention according to FIG. 3, with the electrically shielded sheathed cable after assembling the clamping sleeve and the clamping cage.

The clamping sleeve 11 and the clamping cage 12 are designed in a corresponding hollow cylindrical manner and are arranged at least in part one engaging over the other. As illustrated in FIG. 4, said clamping sleeve and said clamping cage are able to clamp the shielding braid 8 between each other at a clamping site 16. The clamping sleeve 11 comprises at the front inside in addition a cylindrically shaped receiving chamber 17 for the contact carrier 5 and supports said contact carrier in the axial direction. The clamping cage 12 comprises at the front inside a receiving chamber 34 for the clamping sleeve 11 and at the rear inside a cylindrical stowage space 22 for the shielding braid 8. An O-ring 18 that seals the clamping cage 12 with respect to the housing 4 is arranged in the region of the stowage space 22 outside on the clamping cage 12. In the region of the end cap 6, the clamping cage 12 comprises inside a cable sealing ring 19 with which the sheathed cable 9 may be sealed with respect to the clamping cage 12 by means of the screwed-on end cap 6.

Figure 2:
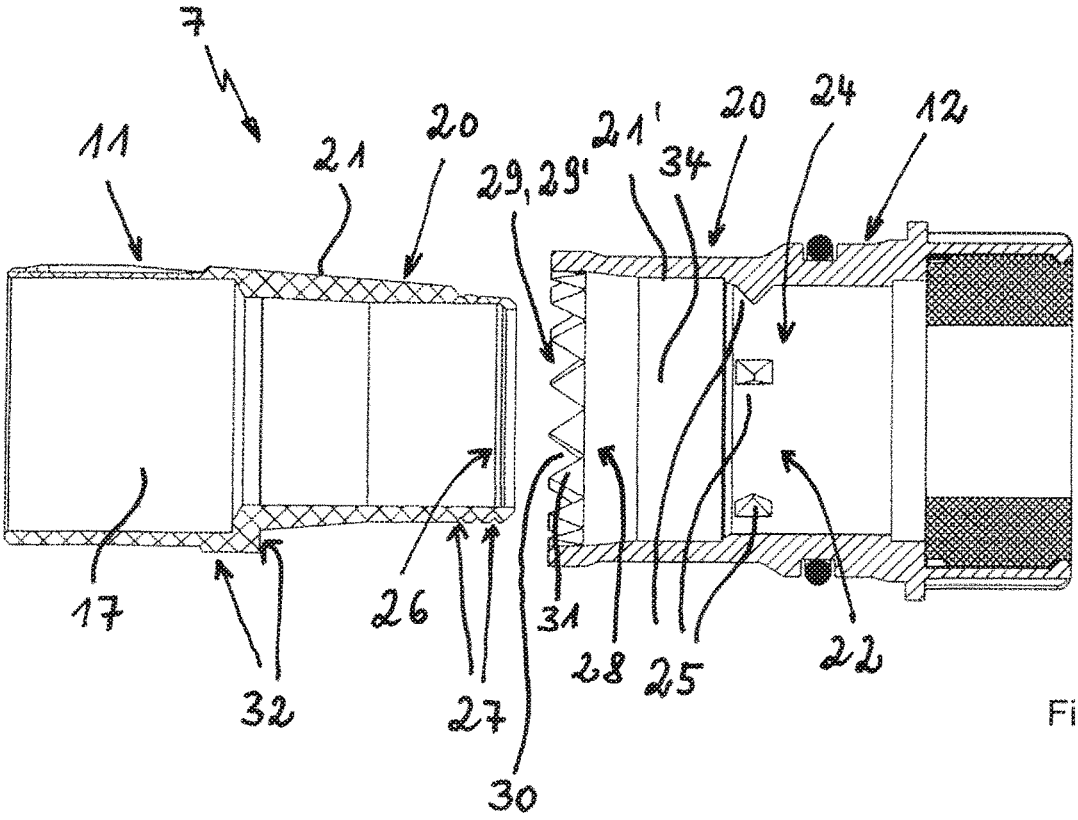
FIG. 2 illustrates in a longitudinal sectional view the cable shield contacting device in accordance with the invention according to FIG. 1, disassembled into the clamping sleeve and the clamping cage.

FIG. 2 illustrates in a disassembled state the cable shield contacting device 7 in accordance with the invention shown in FIG. 1. The clamping sleeve 11 and the clamping cage 12 are not engaging one another in the figure. The two individual parts 11, 12 of the cable shield contacting device 7 are illustrated in the longitudinal sectional view. The electrical cable shield contacting device 7 is provided for the above described electrical plug connector 1 for contacting a shielding braid 8 of the electrical shielded sheathed cable 9, wherein the plug connector 1 comprises a housing 4 that has an at least in part cylindrical inner (2) and outer (3) circumference, having a contact carrier 5 that is arranged in the housing 4, and an end cap 6 that may be screwed onto the housing.

The cable shield contacting device 7 is designed in two parts and may be inserted into the housing 4. Said cable shield contacting device comprises the clamping sleeve and the clamping cage 12 that are designed in a corresponding hollow cylindrical manner and that are arranged, as illustrated in FIGS. 1 and 4, at least in part one engaging over the other and that clamp the shielding braid 8 between one another at a clamping site 16 that is apparent in FIG. 4. The clamping sleeve 11 and the clamping cage 12 comprise sheath surfaces 21, 21' that in the assembled state are spaced away from one another in an overlapping region 20, said sheath surfaces forming in a radially delimiting manner a circumferential annular duct-shaped stowage space 22 for receiving a length region 23 that is part of the shielding braid 8 and overlaps the clamping sleeve 11 and the clamping cage 12 in the axial direction. The sheath surface 21 may be an outer sheath surface of the clamping sleeve 11 and the sheath surface 21' may be an inner sheath surface of the clamping cage 12.

In this case, the clamping sleeve 11 and the clamping cage 12 may be rotated with respect to one another and form with one another a coiling device 24 for the length region 23 that is part of the shielding braid 8 and overlaps the clamping sleeve 11 and/or the clamping cage in the axial direction. A plurality of radially-protruding, bend-rigid shielding braid entraining elements 25 that are arranged on an imaginary circular ring and extend as far as the outer sheath surface 21 of the clamping sleeve 11 are formed on the inner sheath surface 21' of the clamping cage 12, as illustrated in FIGS. 1 and 4. The shielding braid entraining elements 25 are part of the coiling device 24. On a front sleeve end 26 that may be engaged or is engaged by the clamping cage 12, the sheath surface 21 of the clamping sleeve 11 comprises multiple circumferential annular grooves 27, into which the shielding braid entraining elements 25 engage, and latch the clamping cage 12 with the clamping sleeve 11. The shielding braid entraining elements 25 are designed in the shape of a pyramid with an entraining tip.

The clamping cage 12 comprises on its end face 28 that faces the clamping sleeve 11 a circumferential end profiling 29 for fixing in a rotation-resistant manner in the housing 4, said profiling comprises a plurality of mutually adjacent depressions 30 and elevations 31 that form a closed profiled annular ring 29'. Furthermore, the clamping sleeve 11 comprises in a middle region outside a circumferential annular step 32 and/or a circumferential annular collar 32 against which the end profiling 29 of the clamping cage 12 is in contact when the cable shield contacting device 7 is in the assembled state. As FIGS. 1 and 4 illustrate, the end profiling 29 or the profiled annular ring 29' protrude beyond the annular step or rather the annular collar 32 in the radial direction. The overhang that results from this supports the clamping cage 12 in the axial, radial and/or circumferential direction in the housing 4 against an allocated counter bearing that is provided inside and illustrated in FIG. 1. It is consequently arranged in a positionally-stable manner in the housing 4.

Figure 3:
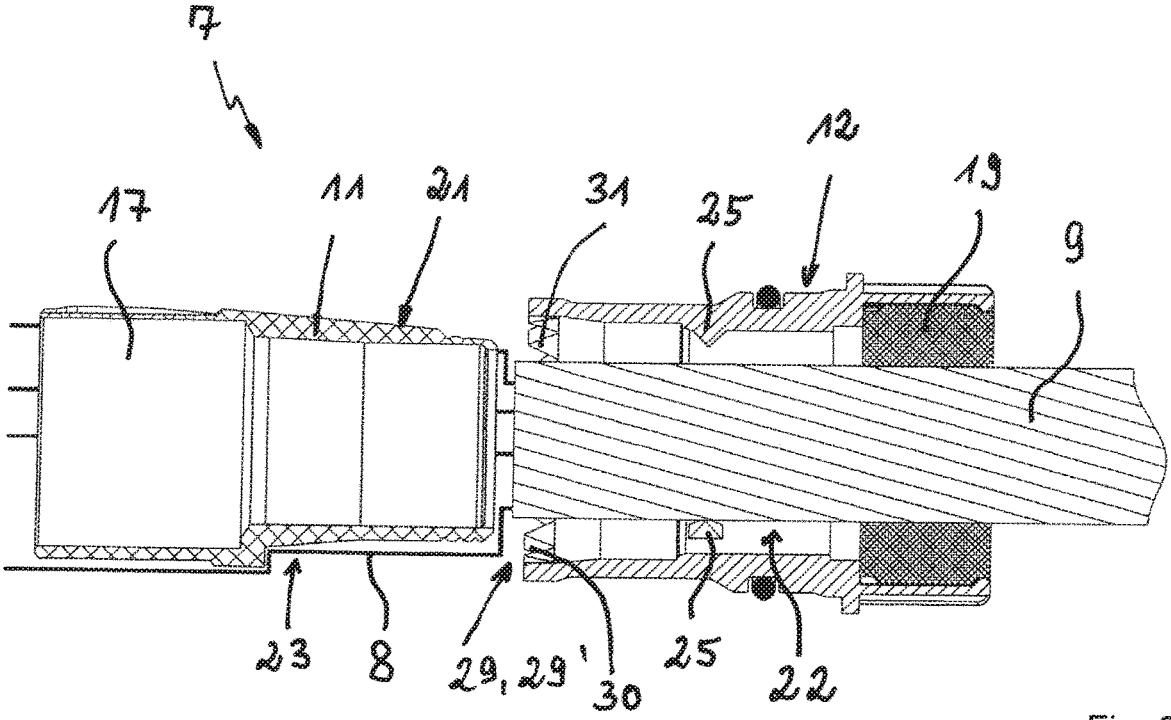
FIG. 3 illustrates in a longitudinal sectional view the cable shield contacting device in accordance with the invention according to FIG. 2, with the electrically shielded sheath cable prior to assembling the clamping sleeve and the clamping bracket.

FIGS. 3 and 4 illustrate the procedure of assembling the electrical cable shield contacting device 7 on the electrical shielded sheathed cable 9. The assembly procedure is performed prior to inserting the cable shield contacting device 7 into the housing 4 and in fact in two steps. FIG. 3 illustrates the first step, FIG. 4 illustrates the second step. After the second step, the length region 23 that is part of the shielded braid 8 and overlaps the clamping sleeve 11 and/or the clamping cage 12 in the axial direction may be coiled in the form of a spiral by means of the coiling device 24 into the circumferential annular duct-shaped stowage space 22 of the cable shield contacting device 7, wherein the shielding braid 8 is possibly simultaneously automatically debraided in part or not at all by way of the shielding braid entraining elements 25.

According to FIG. 3, during the procedure of assembling the electrical cable shield contacting device 7, a long region is initially stripped from the sheathed cable 9 at the front end that is to be connected to the plug connector 1 with the result that the shielding braid 8 is exposed. Thereafter, the stripped end is pushed through the cable sealing ring 19 into the clamping cage 12. In this case, the clamping sleeve 11 is still separate from the clamping cage 12. Subsequently, the length region 23 that is part of the shielding braid 8 and overlaps the clamping cage 12 in the axial direction is somewhat spread out in the radial direction and the clamping sleeve 11 is pushed in the axial direction under the shielding braid 8. In so doing, the length region 23 that is part of the shielding braid 8 and overlaps the clamping cage 12 in the axial direction, as FIG. 3 illustrates, lies against the outer sheath surface 21 of the clamping sleeve 11 and extends to a great extent in the axial direction of the cable shield contacting device 7.

According to FIG. 4, thereafter the clamping sleeve 11 is inserted into the hollow cylindrical clamping cage 12, wherein the length region 23 that is part of the shielding braid 8 and overlaps the clamping cage 12 in the axial direction, comes to lie between the inner sheath surface 21' of the clamping cage 12 and the outer sheath surface 21 of the clamping sleeve 11. In so doing, the shielding braid entraining elements 25 of the clamping cage 12 penetrate the shielded braid 8 in the overlapping region 20 and latch into the circumferential annular grooves 27 of the engaging sleeve end 26 of the clamping sleeve 11, with the result that the clamping sleeve 11 and the clamping cage 12 are latched with one another. In so doing, the circumferential annular duct-shaped stowage space 22 is simultaneously formed into which the length region 23 that is part of the shielding braid 8 and overlaps the clamping sleeve 11 and/or the clamping cage 12 in the axial direction may be coiled in the form of a spiral by means of the coiling device 24. As the clamping sleeve 11 is inserted into the clamping cage 12, the length region 23 that is part of the shielding braid 8 is placed around the cable shield contacting device 7 initially in the radial direction and thereafter in the axial direction. In so doing, the shielding braid 8 extends along the circumferential end profiling 29 or the closed profiled annular ring 29', wherein the length region 23 that is part of the shielding braid 8 penetrates the depressions 30 of the end profiling 29.

The elevations 31 of the profiled annular ring 29' are in this case in contact with the annular collar or the annular step 32 of the clamping sleeve 11 with the result that the shielding braid 8 is not clamped in at this site. Consequently, by rotating the clamping sleeve 11 with respect to the clamping cage 12 or by rotating the clamping cage 12 with respect to the clamping sleeve 11, the length region 23 that is part of the shielding braid 8 and overlaps the clamping cage 12 in the axial direction may be coiled entirely or in part into the stowage space 22 electrical cable shield contacting device 7 by means of the coiling device 24. After coiling in the form of a spiral the length region 23 that is part of the shielding braid 8 and forming the connection of the plug contacts 33 of the contact carrier 5 to the central cables of the sheathed cable 9, not illustrated in the figures, said cables being encompassed by the shielding braid 8, the cable shield contacting device 7 that is in electrically conductive contact with the shielding braid 8 at a clamping site 16 may be inserted according to FIG. 1 into the plug connector 1 from the rear in its housing 4 and may be fixed therein by means of the end cap 6. The clamping site 16 of the shielding braid 8 is situated at the front sleeve end 26 of the clamping sleeve 11, said front end being engaged by the clamping cage 12.

The invention claimed is:

1. An electrical cable shield contacting device for an electrical plug connector for contacting a shielding braid of an electrical shielded sheathed cable, wherein the plug connector comprises a housing that has an at least in part cylindrical inner and outer circumference, a contact carrier that is arranged in the housing and an end cap that may be screwed onto the housing, and wherein the cable shield contacting device is designed at least in two parts and may be inserted into the housing, comprises a clamping sleeve and a clamping cage that are designed in a corresponding cylindrical manner and are arranged at least in part one engaging over the other, and that clamp the shielding braid between one another at a clamping site, the clamping sleeve and the clamping cage comprise sheath surfaces that are spaced away from one another in their overlapping region, said sheath surfaces forming a circumferential annular duct-shaped stowage space for receiving a length region that is part of the shielding braid and that overlaps the clamping sleeve and the clamping cage in the axial direction, the clamping sleeve and the clamping cage may be rotated with respect to one another and form with one another a coiling device for the length region that is part of the shielding braid and overlaps the clamping sleeve and/or the clamping cage in the axial direction, and the sheath surface of the clamping cage comprises a plurality of radially protruding shielding braid entraining elements that are arranged on one or multiple circular rings and extend as far as the sheath surface of the clamping sleeve wherein in the sheath surface of the clamping sleeve comprises on a front sleeve end that is engaged by the clamping cage one or multiple circumferential annular grooves, annular collars and/or annular steps into which and/or behind which the shielding braid entraining elements engage, and rotatably latch the clamping cage with the clamping sleeve.

2. The electrical cable shield contacting device as claimed in claim 1, wherein the shielding braid entraining elements are designed in the shape of a pyramid.

3. The electrical cable shield contacting device as claimed in claim 1, wherein the clamping cage comprises on its end face that faces the clamping sleeve a circumferential end profiling for fixing in a rotation-resistant manner in the housing, said profiling comprising a plurality of mutually adjacent depressions and elevations that form a closed profiled annular ring.

4. The electrical cable shield contacting device as claimed in claim 3, wherein the clamping sleeve comprises in a middle region outside a circumferential annular step and/or a circumferential annular collar against which the end profiling of the clamping cage is in contact.

5. The electrical cable shield contacting device as claimed in claim 4, wherein the end profiling protrudes in the radial direction beyond the annular step or the annular collar.

6. The electrical cable shield contact device as claimed in claim 1, wherein, apart from the depressed annular grooves and the protruding shielding braid entraining elements, the sheath surfaces of the clamping sleeve and of the clamping cage are designed in their overlapping region with smooth walls.

7. An electrical plug connector having a housing that has an at least in part cylindrical inner and outer circumference, a contact carrier that is arranged in the housing and an end cap that may be screwed onto the housing, and having an electrical cable shield contacting device for contacting a shielding braid of an electrical shielded sheathed cable, wherein the electrical cable shield contacting device is as claimed in claim 1.

8. The electrical plug connector as claimed in claim 7 wherein when the cable shield contacting device is inserted into the housing, the clamping sleeve having the annular collar is supported on a counter bearing of the housing in an unshiftable manner in the axial direction and the clamping cage having the end profiling lies against a counter profiling of the housing in a non-rotatable manner in the circumferential direction.

9. The electrical plug connector as claimed in claim 7, wherein the cable shield contacting device that is inserted into the housing is fixed in the housing in a non-movable manner in the axial direction and in the circumferential direction by means of the end cap that may be screwed onto the housing.

* * * * *